US008191937B2

(12) United States Patent
Lin

(10) Patent No.: US 8,191,937 B2
(45) Date of Patent: Jun. 5, 2012

(54) AUTOMATIC HIDDEN LATCH STRUCTURE

(75) Inventor: Ching-Tien Lin, Xinzhuang (TW)

(73) Assignee: Thase Enterprise Co. Ltd., Taipei County (TW)

( * ) Notice: Subject to any disclaimer, the term of this patent is extended or adjusted under 35 U.S.C. 154(b) by 353 days.

(21) Appl. No.: 12/552,835

(22) Filed: Sep. 2, 2009

(65) Prior Publication Data

US 2010/0259052 A1 Oct. 14, 2010

(30) Foreign Application Priority Data

Apr. 9, 2009 (TW) ..... 98205729 U

(51) Int. Cl.

| | |
|---|---|
| ***E05C 9/12*** | (2006.01) |
| ***E05C 19/06*** | (2006.01) |
| ***E05C 1/02*** | (2006.01) |
| ***E05C 1/04*** | (2006.01) |
| ***E05C 1/08*** | (2006.01) |

(52) U.S. Cl. ..... 292/58; 292/56; 292/89; 292/137; 292/162; 292/163

(58) Field of Classification Search ..... 292/56, 292/89, 137, 162, 163
See application file for complete search history.

(56) References Cited

U.S. PATENT DOCUMENTS

| | | | | |
|---|---|---|---|---|
| 3,582,122 | A * | 6/1971 | Foster et al. | 292/335 |
| 4,005,886 | A * | 2/1977 | Lirette | 292/177 |
| 4,099,753 | A * | 7/1978 | Gwozdz et al. | 292/177 |
| 4,445,717 | A * | 5/1984 | Imhoff | 292/177 |
| 4,611,840 | A * | 9/1986 | Martin | 292/177 |
| 5,024,472 | A * | 6/1991 | Cohrs | 292/182 |
| 5,076,620 | A * | 12/1991 | Campbell et al. | 292/138 |
| 6,409,231 | B1 * | 6/2002 | Rusiana | 292/33 |
| 6,883,837 | B1 * | 4/2005 | Lin | 292/33 |
| 7,287,784 | B2 * | 10/2007 | Lin | 292/92 |

* cited by examiner

*Primary Examiner* — Thomas Beach
*Assistant Examiner* — Nathan Cumar
(74) *Attorney, Agent, or Firm* — Shoemaker and Mattare

(57) ABSTRACT

An automatic hidden latch structure includes: a base secured in position to a close side of a door, the base having a positioning plate for positioning and a receiving portion and a block portion disposed at one side of the positioning plate; a transmission mechanism including a lock tongue disposed in and protruding from the receiving portion, a transmission member abutting against the lock tongue, a rotating member driven by the transmission member, and an engaging member engaging with the rotating member and protruding from the receiving portion, a first elastic element insertably engaing the engaging member, and a second elastic element mounted on a joining member of the engaging member and insertably engaging the joining member. Given actuation of the mechanism, a latch post of the automatic hidden latch structure protrudes from the door whenever the lock tongue is pressed upon, thereby locking the door.

7 Claims, 5 Drawing Sheets

AUTOMATIC HIDDEN LATCH STRUCTURE

BACKGROUND OF THE INVENTION

1. Field of the Invention

The present invention relates generally to automatic hidden latch structures, and more particularly to a latch structure provided in a door and retractable into the door quickly when the door is opened.

2. Description of Related Art

In general, doors of houses and buildings are usually provided with latch structures besides handle structures or lock structures. The latch structures are usually disposed between the doorframe and an upper portion of the door or between a lower portion of the door and the floor.

The latch structures increase the structural strength of the doors locked and prevents illegal unlocking of the doors. However, a user locking the door also has to lock a latch structure which plays an auxiliary role in locking the door. Accordingly, a plethora of locks are usually installed on the door, thereby causing interference between the locks and adversely affecting the door appearance.

Further, a conventional latch structure is usually complex, and the user has to perform two steps for unlocking the latch structure. More badly, once the door is opened, the cap of the latch structure may protrude toward the floor or the door header, thereby scratching the floor or the door header and even the cap of the latch structure. The severely scratched latch structure is destined to be damaged and shortlived.

Therefore, there is a need to provide a latch structure so as to overcome the above drawbacks.

SUMMARY OF THE INVENTION

According to the above drawbacks, an object of the present invention is to provide a latch structure automatically hidden in a door so as to provide a latching function without adversely affecting the configuration of the door.

Another object of the present invention is to provide an automatic hidden latch structure retractable into a door quickly when the door is unlocked and opened.

In order to achieve the above and other objects, the present invention provides an automatic hidden latch structure provided in a close side-equipped door of a double-door device. The automatic hidden latch structure comprises: a base secured in position to the close side of the door, wherein the base has a positioning plate for positioning, and a receiving portion and a block portion disposed at one side of the positioning plate; a transmission mechanism disposed in the receiving portion, wherein the transmission mechanism comprises: a lock tongue disposed in and protruding from the receiving portion, a transmission member abutting against the lock tongue, a rotating member arranged to be driven by the transmission member, and an engaging member engaging with the rotating member and protruding from the receiving portion; and a latch mechanism mounted on the block portion and joined with the engaging member, wherein the latch mechanism comprises: a first elastic element and a check ring disposed around the engaging member, a joining member mounted on the bottom of the engaging member, and a latch post and a bump mounted on the joining member for latching the door.

The positioning plate has a first opening, and the receiving portion has a receiving slot penetrating therethrough and corresponding in position to the first opening. Furthermore, one end of the block portion has a U-shaped plate for connecting with the positioning plate, the U-shaped plate has an upper plate corresponding in position to the receiving slot and an opposing lower plate. Both the upper and lower plates have corresponding openings formed therein.

The transmission mechanism is disposed in the receiving slot of the receiving portion.

The transmission member has a sloped transmission portion, and the rotating member has an engaging portion, a rolling member and a rotating shaft. The transmission portion of the transmission member leans against the rolling member of the rotating member such that the rotating member swings around the rotating shaft.

The engaging member has a hook portion for engaging with the engaging portion of the rotating member, and has a check plate. With the first elastic element and check ring being disposed between the check plate and the upper plate of the block portion, reinstating the engaging member by the first elastic element is allowable. Furthermore, the engaging member has a hollow shaft body disposed below the check plate, and a groove is formed in the hollow shaft body. The joining member is disposed in the hollow shaft body. A pin penetrates the groove and is secured in position to the joining member. A second elastic member insertably engages the joining member between the end of the hollow shaft body and the end of the joining member so as to push the joining member outward and meanwhile allow the latch post and the bump disposed at the end of the joining member to protrude and retract resiliently.

The latch mechanism is disposed in the U-shaped plate of the block portion. The engaging member and the joining member mounted on the bottom of the engaging member are arranged to pass through the openings of the upper plate and the lower plate.

According to the present invention, when the door is at a close state, the lock tongue is pushed against by the close side such that the transmission member is moved so as to drive the rotating member to rotate, and the rotating member further pushes against the engaging member, thereby causing the latch post and the bump to protrude outward; on the other hand, when the door is at an open state, the close side doest not push against the lock tongue, instead, the first elastic element pushes against the engaging member in an opposite direction so as to make the rotating member push against the transmission member and the lock tongue, thereby causing the lock tongue to protrude outward and the latch post and bump to retract inward. Therefore, the automatic hidden latch structure of the present invention is automatically hidden in the door, when the door lock is unlocked and the door is opened, the latch post and bump can automatically retract inward so as to release the latching state.

Therefore, the automatic hidden latch structure of the present invention provides a latching function that enhances the locking structure when the door lock is locked and automatically releases the latching state when the door is opened, thereby simplifying the operation and overcoming the conventional drawbacks.

DETAILED DESCRIPTION OF PREFERRED EMBODIMENTS

The following illustrative embodiments are provided to illustrate the disclosure of the present invention, these and other advantages and effects can be apparent to those skilled in the art after reading the disclosure of this specification.

Figure 1:
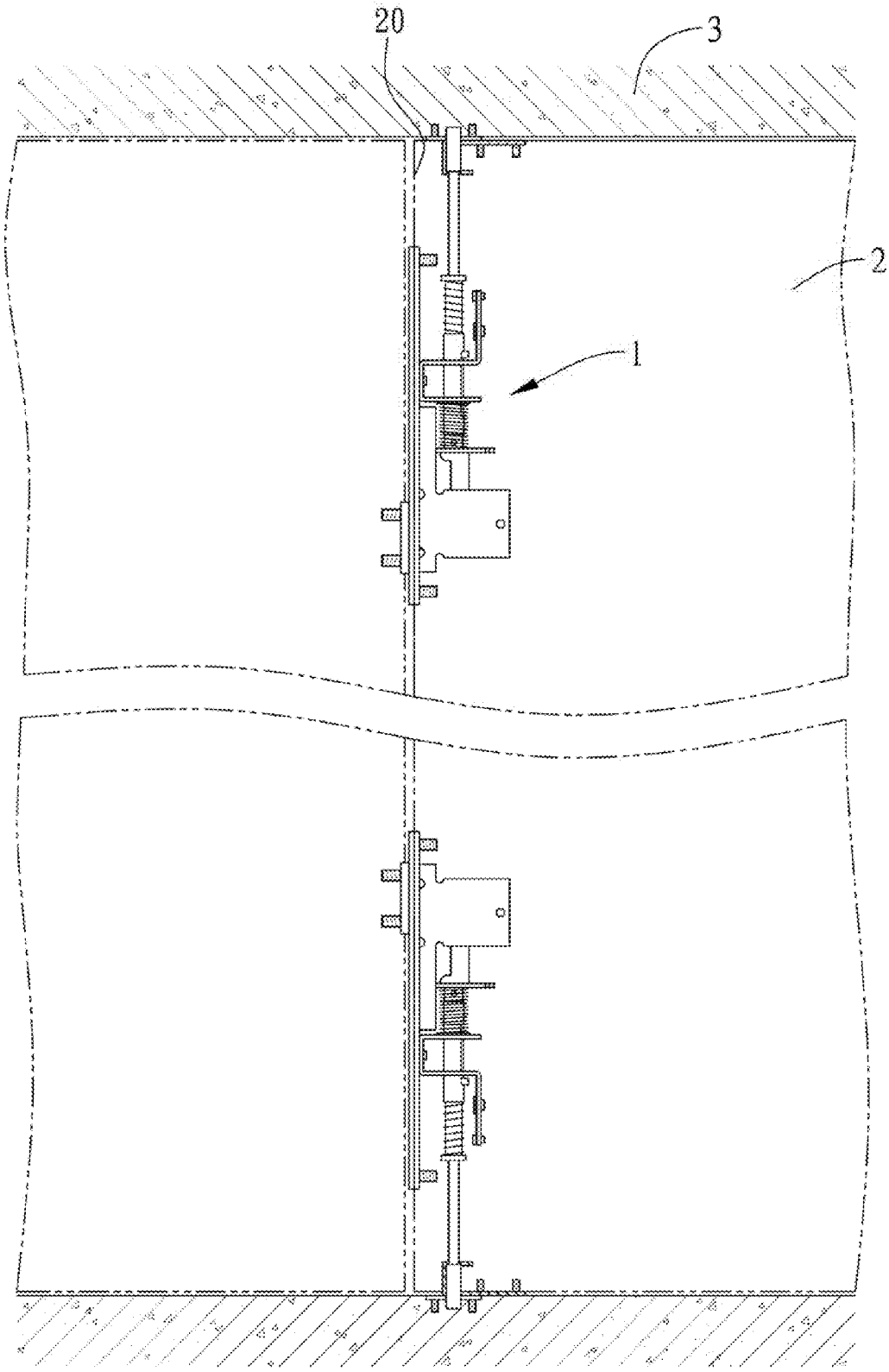
FIG. 1 shows a double-door device with an automatic hidden latch structure disposed therein.

FIG. 1 shows a double-door device with an automatic hidden latch structure 1 disposed therein. As shown in the drawing, the double-door device is mounted on a building 3, and the automatic hidden latch structure 1 is provided in a door 2 and near the close side 20 of the door 2.

Figure 2:
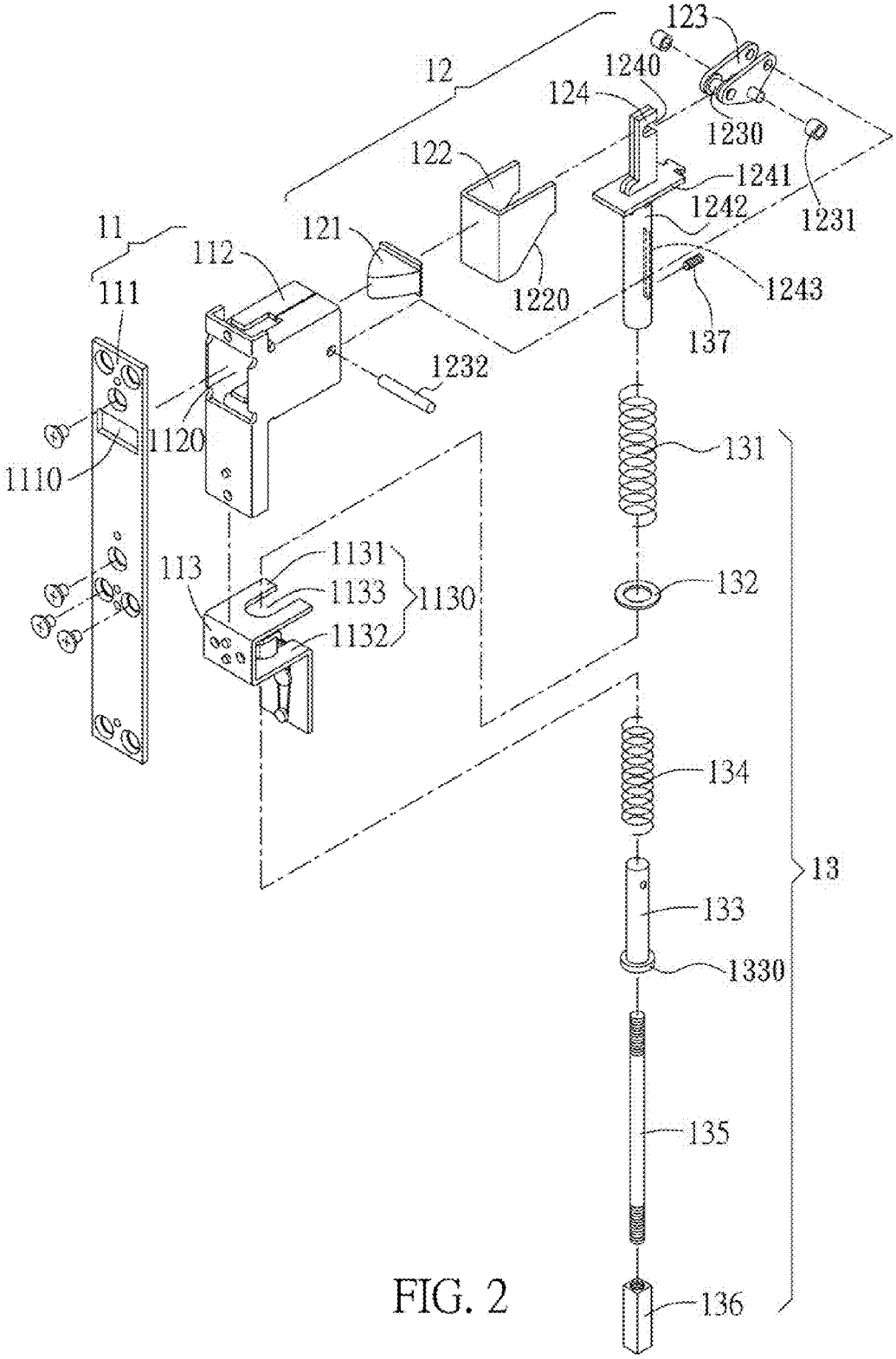
FIG. 2 is an exploded view of the automatic hidden latch structure according to the present invention.

Referring to FIG. 2, the automatic hidden latch structure 1 comprises: a base 11, a transmission mechanism 12, and a latch mechanism 13.

The base 11 is secured in position to the door 2 and is near the close side 20 of the door 2. The base 11 has a positioning plate 111 configured for vertical fixation, a receiving portion 112 and a block portion 113 disposed on one side of the positioning plate 111. The positioning plate 111 has a first opening 1110, and the receiving portion 112 has a receiving slot 1120 penetrating the receiving portion 112 and corresponding in position to the first opening 1110. A U-shaped plate 1130 is disposed at one end of the block portion 113 for connecting with the positioning plate 111. The U-shaped plate 1130 comprises an upper plate 1131 corresponding in position to the receiving slot 1120 and an opposing lower plate 1132. The upper plate 1131 and the lower plate 1132 have corresponding opening 1133 formed therein.

The transmission mechanism 12 is disposed in the receiving slot 1120 of the receiving portion 112. The transmission mechanism 12 comprises a lock tongue 121 disposed in the receiving slot 1120 and protruding from the first opening 1110, a transmission member 122 abutting against the lock tongue 121, a rotating member 123 arranged to be driven by the transmission member 122, and an engaging member 124 engaging with the rotating member 123 and protruding from the receiving slot 1120. The transmission member 122 has a sloped transmission portion 1220. The rotating member 123 has an engaging portion 1230, a rolling member 1231, and a rotating shaft 1232. The transmission portion 1220 of the transmission member 122 leans against the rolling member 1231 of the rotating member 123 such that the rotating member 123 swings around the rotating shaft 1232.

The latch mechanism 13 is disposed in the U-shaped plate 1130 of the block portion 113. The latch mechanism 13 has a first elastic element 131 and a check ring 132 insertably engaging the engaging member 124, a joining member 133 mounted on the bottom of the engaging member 124, a second elastic element 134 insertably engaging the joining member 133, and a latch post 135 and a bump 136 mounted on the joining member 133 and configured to be locked to the building 3. The engaging member 124 has a hook portion 1240 for engaging with the engaging portion 1230 of the rotating member 123. The engaging member 124 further has a check plate 1241. The first elastic element 131 and the check ring 132 are disposed between the check plate 1241 and the upper plate 1131 of the block portion 113 so as to allow the engaging member 124 to be reinstated by the first elastic member 131. A hollow shaft body 1242 is disposed below the check plate 1241 of the engaging member 124, and a groove 1243 is formed in the hollow shaft body 1242. The joining member 133 is penetratingly disposed in the hollow shaft body 1242. A pin 137 penetrates the groove 1243 and is secured in position to the joining member 133, thereby limiting the range of protrusion and retraction of the joining member 133 by sliding the pin 137 along the groove 1243. The second elastic element 134 insertably engages the joining member 133 between the end of the hollow shaft body 1242 and the end 1330 of the joining member 133 such that the second elastic element 134 pushes the joining member 133 outward. The latch post 135 and the bump 136 mounted on the end of the joining member 133 can protrude and retract resiliently by means of the second elastic element 134 so as to prevent the latching of outermost said bump 136 from being adversely affected by the gap otherwise caused by the swing of the door 2 when the door 2 is opened or closed.

Figure 3A:
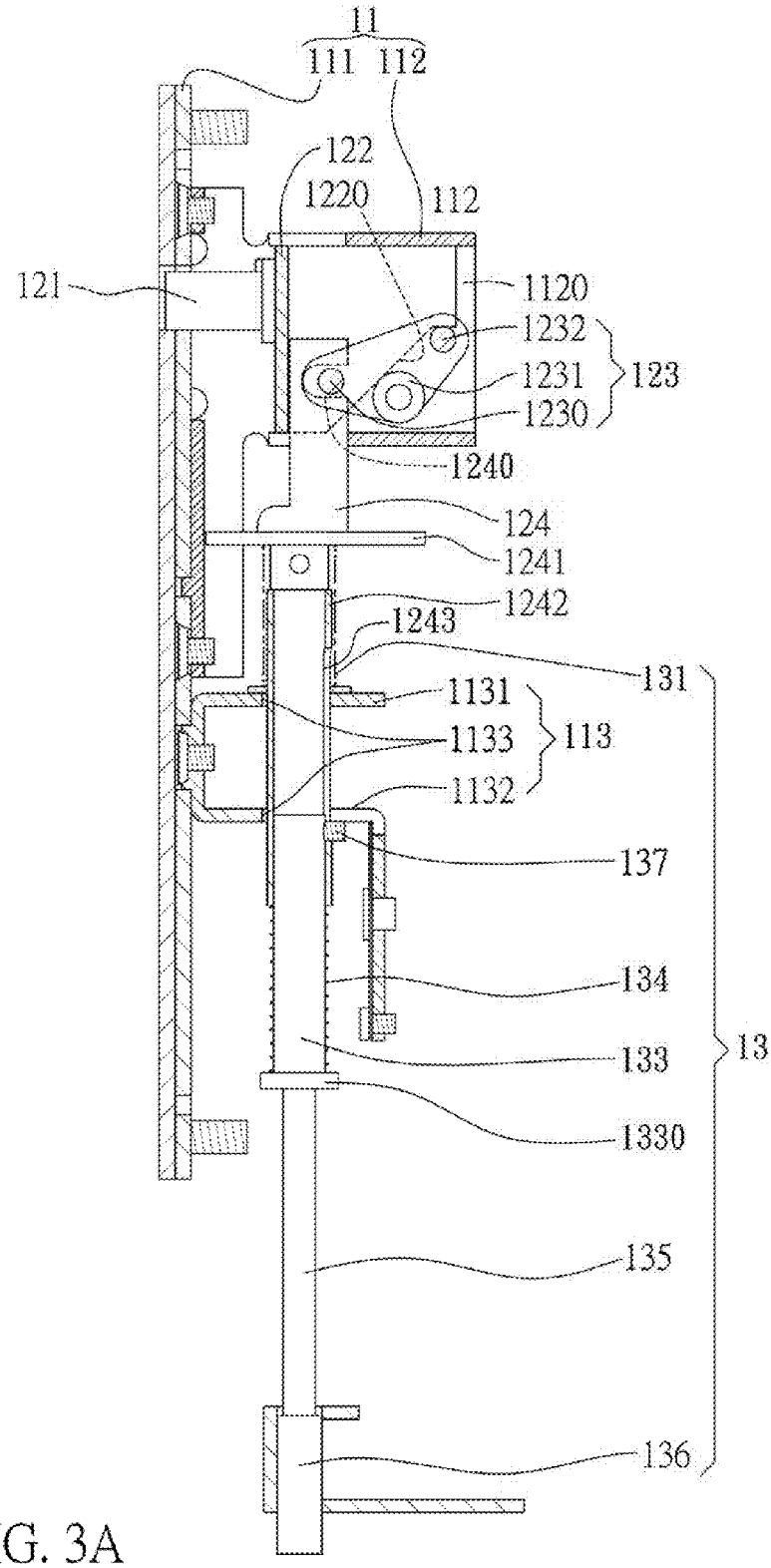
FIG. 3A is a sectional view of the automatic hidden latch structure when the door is closed.
Figure 3B:
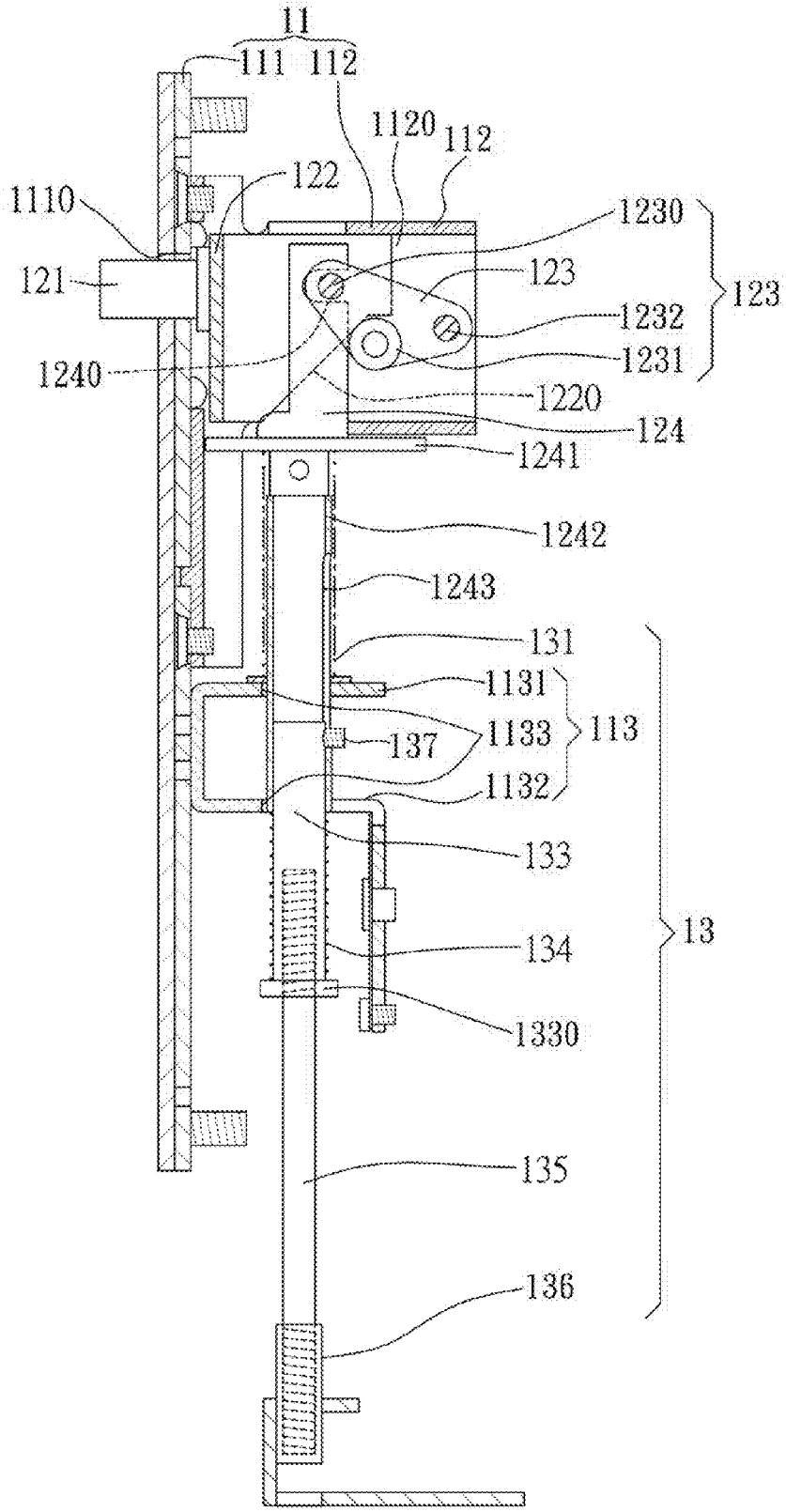
FIG. 3B is a sectional view of the automatic hidden latch structure when the door is opened.

FIGS. 3A and 3B are sectional views of the automatic hidden latch structure 1 when the door is closed and opened, respectively.

As shown in FIG. 3A, when the door is closed, the lock tongue 121 is abutted and pressed by the other door (not shown) of the double-door device and thus retracts into the receiving slot 1120 of the receiving portion 112. The lock tongue 121 further pushes the transmission member 122 towards the rotating member 123 such that the sloped transmission portion 1220 of the transmission member 122 leans against the rolling member 1231 of the rotating member 123, thereby causing the rotating member 123 to swing around the rotating shaft 1232. Since the engaging portion 1230 of the rotating member 123 leans against the hook portion 1240 of the engaging member 124, the engaging member 124 is pushed downwards such that the latch post 135 and the bump 136 of the latch mechanism 13 mounted on the bottom of the engaging member 124 extend outwards for latching the door.

As shown in FIG. 3B, when the door 2 is opened, the lock tongue 121 is free of pressure. The engaging member 124 is reinstated and pushed upward by the elastic force of the first elastic element 131 insertably engaging the engaging member 124. As a result, the engaging portion 1230 of the engaging member 124 pushes against the rotating member 123, and in consequence the rolling member 1231 of the rotating member 123 pushes against the sloped transmission portion 1220 of the transmission member 122, thereby pushing the lock tongue 121 outward and releasing the latching state of the latch mechanism 13.

Figure 4:
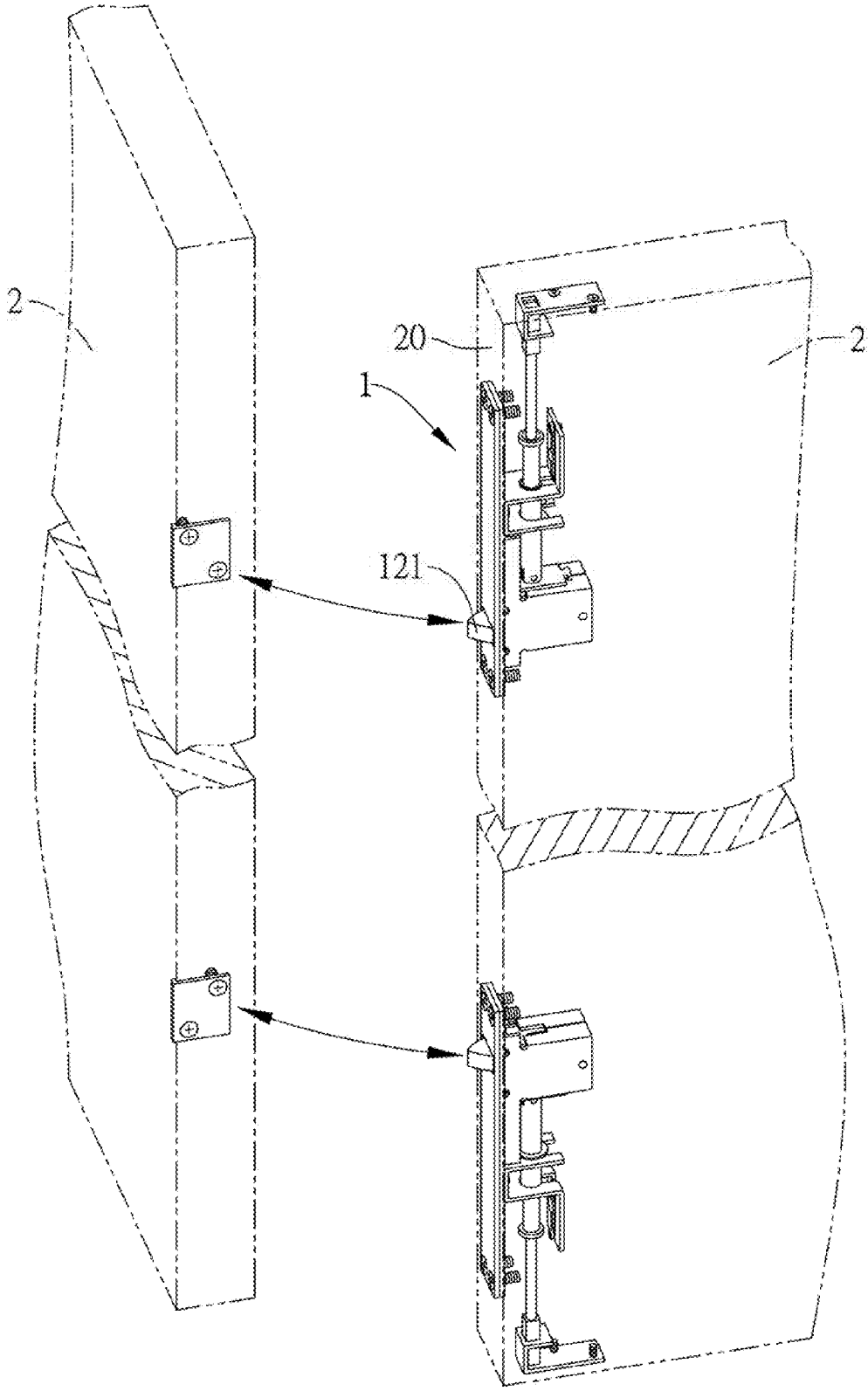
FIG. 4 is a perspective view of the automatic hidden latch structure when the door is opened.

FIG. 4 shows the latch structure when the door is completely opened. The lock tongue 121 extends outwards; meanwhile, the latch post 135 mounted on the joining member 133 completely retracts into the base 11, thereby completely releasing the latching state of the automatic hidden latch structure 1.

On the other hand, when the door 2 is closed, the lock tongue 121 is pressed upon so as to cause the bump 136 at the end of the latch post 135 to extend outward for latching the door.

According to the present invention, the automatic hidden latch structure is automatically hidden in the door. When the door lock is unlocked and the door is opened, the latch post and the bump automatically retract into the door so as to release the latching state. On the other hand, when the door is closed, the latch post and the bump extend outward so as to latch the door, thereby providing an enhanced locking structure without the need of performing a locking or unlocking operation to the latch structure and accordingly simplifying the door opening and closing operation.

Therefore, the latch structure of the present invention helps to enhance the locking function, simplifies and facilitates the operation and saves spaces.

The above-described descriptions of the detailed embodiments are only to illustrate the preferred implementation according to the present invention, and it is not to limit the scope of the present invention, Accordingly, all modifications and variations completed by those with ordinary skill in the art should fall within the scope of present invention defined by the appended claims.

What is claimed is:

1. An automatic hidden latch structure provided in a door of a double-door device, wherein the door has a close side, comprising:

a base secured in position in the door, proximate to the close side of the door, and having a positioning plate for positioning, a block portion and a receiving portion beside the positioning plate;

a transmission mechanism disposed in the receiving portion and provided with a lock tongue received in and protruding from the receiving portion, a transmission member abutting against the lock tongue, a rotating member driven by the transmission member, and an engaging member fastenably engaging with the rotating member and protruding from the receiving portion, wherein the transmission member has a sloped transmission portion, the rotating member has an engaging portion, a rolling member and a rotating shaft, and the engaging member has a hook portion for engaging with the engaging portion of the rotating member, allowing the transmission portion to lean against the rolling member of the rotating member and the rotating member to swing around the rotating shaft; and a latch mechanism disposed in the block portion, mounted with the engaging member, and provided with a first elastic element and a check ring insertably engaging with the engaging member, a joining member mounted on a bottom of the engaging member, and a latch post and a bump mounted on the joining member for latching the door;

wherein, with the door being closed, the lock tongue is pushed against by the close side of the door such that the transmission member is moved so as to drive the rotating member to rotate, and thus the rotating member pushes the engaging member, thereby pushing the latch post and the bump away from the engaging member; and wherein, with the door being open, the lock tongue is not pushed against by the close side of the door, allowing the first elastic element to push backward against the engaging member and thus the rotating member to push the transmission member and the lock tongue, thereby causing the lock tongue to protrude outward and the latch post and bump to retract inward.

2. The automatic hidden latch structure of claim 1, wherein the positioning plate has a first opening terminally corresponding in position to a receiving slot formed in the receiving portion to penetrating therethrough and is connected to a U-shaped plate provided at an end of the block portion, the U-shaped plate comprising an upper plate corresponding in position to the receiving slot and an opposing lower plate, and the upper and lower plates having openings corresponding in position to each other.

3. The automatic hidden latch structure of claim 2, wherein the transmission mechanism is disposed in the receiving slot of the receiving portion.

4. The automatic hidden latch structure of claim 1, wherein the engaging member has a check plate, and, with the first elastic element and check ring being disposed between the check plate and the upper plate of the block portion, reinstating the engaging member by the first elastic element is allowable.

5. The automatic hidden latch structure of claim 4, wherein a hollow shaft body formed with a groove therein is disposed below the check plate of the engaging member, allowing the joining member to be disposed in the hollow shaft body and a pin to penetrate the groove and secured in position to the joining member, thereby limiting a range of protrusion and retraction of the joining member by sliding the pin along the groove.

6. The automatic hidden latch structure of claim 5, wherein a second elastic member insertably engages with the joining member between the end of the hollow shaft body and the end of the joining member so as to allow the second elastic member to push the joining member outward, and, with the latch post and bump being mounted on the end of the joining member, resilient protrusion and retraction of the latch post and bump by the second elastic member is allowable.

7. The automatic hidden latch structure of claim 2, wherein the latch mechanism is disposed in the U-shaped plate of the block portion, and the engaging member and the joining member mounted on the bottom of the engaging member are allowed to pass through the openings of the upper plate and the lower plate.

* * * * *